US007219450B2

(12) United States Patent
Langley

(10) Patent No.: US 7,219,450 B2
(45) Date of Patent: May 22, 2007

(54) SHOE SUPPORT SYSTEM

(76) Inventor: Eric L. Langley, 3711 McLarty, Dallas, TX (US) 75241

( * ) Notice: Subject to any disclaimer, the term of this patent is extended or adjusted under 35 U.S.C. 154(b) by 78 days.

(21) Appl. No.: 10/734,409

(22) Filed: Dec. 12, 2003

(65) Prior Publication Data

US 2005/0126044 A1 Jun. 16, 2005

(51) Int. Cl.
*A43B 7/20* (2006.01)

(52) U.S. Cl. ..... 36/89; 36/88; 36/10

(58) Field of Classification Search ..... 36/10, 36/55, 88, 89, 7.8, 27, 69, 92, 118.2, 118.3, 36/118.4, 117.1
See application file for complete search history.

(56) References Cited

U.S. PATENT DOCUMENTS 4,455,769 A * 6/1984 Fritsch ..... 36/118.8
4,974,343 A 12/1990 Davidson ..... 36/89
5,056,509 A 10/1991 Swearington ..... 128/80 H
5,090,138 A * 2/1992 Borden ..... 36/102
5,125,171 A * 6/1992 Stewart ..... 36/89
5,317,820 A 6/1994 Bell et al. ..... 36/89
5,319,869 A * 6/1994 McDonald et al. ..... 36/114
5,369,897 A * 12/1994 Rullier ..... 36/117.2
5,430,960 A 7/1995 Richardson ..... 36/89
5,431,624 A * 7/1995 Saxton et al. ..... 602/27
5,446,976 A * 9/1995 Donnadieu et al. ..... 36/117.2
5,467,537 A * 11/1995 Aveni et al. ..... 36/50.1
5,593,383 A 1/1997 DeToro ..... 602/27
5,611,773 A 3/1997 Nash et al. ..... 602/16
5,621,985 A * 4/1997 Frost ..... 36/89
5,640,787 A 6/1997 Spademan ..... 36/117.3
5,678,330 A 10/1997 Van Dyke et al. ..... 36/89
5,700,237 A 12/1997 Hess ..... 602/27
5,894,684 A * 4/1999 Sand et al. ..... 36/117.1
5,897,514 A 4/1999 Currier ..... 602/16
5,908,398 A 6/1999 DeToro ..... 602/16
5,909,885 A * 6/1999 Borel ..... 280/11.231
5,937,546 A * 8/1999 Messmer ..... 36/89
5,944,679 A 8/1999 DeToro ..... 602/27

(Continued)

OTHER PUBLICATIONS

Ace Wire Spring & Form Co., Inc. *Torsion Springs*, 1 pg. article located at Internet website: http://www.acewire.com/pages/torsionrfq.html dated Oct. 21, 2003.

(Continued)

*Primary Examiner*—Marie Patterson
(74) *Attorney, Agent, or Firm*—Grady K. Bergen; Griggs Bergen LLP

(57) ABSTRACT

An exemplary shoe support system is provided to facilitate a support of an ankle of a foot. The support system can include a sole inliner, a coupling, a back inliner, and an upper. The coupling allows movement between the sole inliner to the back inliner, while the upper adjustably secures the sole inliner and back inliner to the foot. The upper, the sole inliner, the coupling, and the back inliner are operable to resist lateral movement of the ankle while permitting dorsiflexion and plantar flexion movement in the foot, and can be configured for integration within a shoe or serve as the shoe. In another configuration, the support system can include a cover, which surrounds the upper, the sole inliner, the coupling, and the back inliner. Additionally, a biasing member can be incorporated with the coupling to urge a predetermined angle between the sole inliner and back inliner.

70 Claims, 7 Drawing Sheets

U.S. PATENT DOCUMENTS

| | | | | |
|---|---|---|---|---|
| 5,992,057 | A * | 11/1999 | Monti | 36/89 |
| 6,018,892 | A * | 2/2000 | Acheson et al. | 36/89 |
| 6,102,881 | A * | 8/2000 | Quackenbush et al. | 602/28 |
| 6,270,468 | B1 | 8/2001 | Townsend et al. | 602/27 |
| 6,302,858 | B1 | 10/2001 | DeToro et al. | 602/5 |
| 6,423,021 | B1 | 7/2002 | Gallegos | 602/23 |
| 6,503,218 | B1 | 1/2003 | Ascheman | 602/23 |
| 6,692,454 | B1 * | 2/2004 | Townsend et al. | 602/27 |
| 2003/0177633 | A1 | 9/2003 | Gallegos | |

OTHER PUBLICATIONS

AnkleBrace.Info, 3 pg. article located at Internet website: http://www.anklebrace.info/products/products.htm, dated Oct. 16, 2003.

The Mueller ATF Ankle Brace, 2 pg. article located at Internet website: http://www.ankleshop.com/muelleraft.htm, dated Jun. 17, 2003.

*Neoprene polychloroprene* 2 pg. article located at DuPont Dow Internet website: http://www.dupont-dow.com/Products/Neoprene/neoprene.asp, dated Oct. 7, 2003.

* cited by examiner

SHOE SUPPORT SYSTEM

TECHNICAL FIELD OF THE INVENTION

This invention relates in general to the field of supports for the human body and more particularly to supports for a foot.

BACKGROUND OF THE INVENTION

One of the most common types of sports-related injuries is a result of an undesired lateral movement in a foot/ankle (e.g., an inversion or eversion movement—that is, a turning in of the ankle—inversion—and a turning out of an ankle—eversion). According to studies, ankle injuries account for 20% to 40% of all sports—related injuries. With such a common occurrence of injuries in ankles, individuals have turned to various foot and/or ankle supports.

One such type of support is tape—commonly referred to as "athletic tape." Athletic tape can be either wrapped around a bare ankle (sometimes a protective covering is put on the bare ankle) or around a shoe after placement of the shoe on the foot—a concept commonly referred to in athletics as a "spatting" of the shoe with tape. Various configurations of tape wrapping exist. For example, the athletic tape can be criss-crossed between the back of the foot and top and bottom parts of the foot.

Other types of supports include braces that are coupled to a foot. Many types of these braces include stirrup supports placed on the outside of the ankle or canvass-type materials, which are laced onto a foot.

Yet other types of supports include hard shells or boots that are designed to completely isolate movement of the foot. Such devices include ski boots and roller blades.

With a large majority of activities, certain movements of the foot are desirable, namely a dorsiflexion movement in the foot and a plantar flexion movement in the foot—that is, an upward movement of the foot (dorsiflexion) and a bending of the foot toward the plantar surface or sole of the foot (plantar flexion). However, the above supports do not necessarily facilitate such movements. For example, the hard shells are designed to prevent such movements; and, research studies suggest that braces and tape can inhibit such movements.

An additional concern of any support is the ability to maintain its support characteristics throughout an activity. Research studies suggest that the support created by athletic tape and braces decreases after commencement of the activity. As a result, these studies suggest that an individual should readjust the athletic tape and braces from time to time, during the activity, to maintain a desired support.

The most common of the above supports tapes is athletic tape. However, due to the inherent nature of athletic tape, time is required to wrap the tape around a foot/ankle before the activity and remove the tape after the activity. Additionally, care must be taken to ensure that the correct wrapping techniques is utilized, that the correct amount of support is placed on the foot/ankle, and that the tape is not too tight—thereby restricting blood flow in the foot/ankle and/or making the taping support uncomfortable. Furthermore, as a result of such care/time constraints, the number of athletes that can be wrapped within a certain time period before an event is limited—thereby making some athletes go without ankle/foot taping. Additionally, the removal of the athletic tape (e.g., on bare ankles) after a performance is generally an uncomfortable processes. Furthermore, athletic tape is generally not a reusable material—thereby making taping a costly and non-environmentally friendly option.

When tape is spat over the outermost part of the shoe, several other undesirable features can occur. Athletic tape on the bottom of the shoe can interfere with the naturally intended performance of the shoe. For example, when wrapped around football shoes, it can cover the cleats of the shoe, thereby potentially interfering with the traction of the shoe—hence, inhibiting the player's performance. Additionally, athletic tape on the side of the shoes can cover designs and logos—something highly undesirable by some shoe manufacturers.

SUMMARY OF THE INVENTION

From the foregoing it may be appreciated that a need has arisen for a support system that supports an ankle of a foot. In accordance with the present invention, a support system is provided that substantially eliminates one or more of the disadvantages and problems outlined above.

According to one aspect of the invention, a support system has been provided that is arranged and designed to support an ankle of a foot. The support system comprises a sole inliner, a coupling, a back inliner, and an upper. The sole inliner is configured for a sole of the foot, while the back inliner is configured for a back of the foot. The coupling movably couples the sole inliner to the back inliner. The upper adjustably secures the sole inliner and back inliner to the foot. The upper, the sole inliner, the coupling, and the back inliner are operable to resist lateral movement of the ankle while permitting dorsiflexion and plantar flexion movement in the foot; and, the upper, the sole inliner, the coupling, and the back inliner are configured for integration within a shoe.

According to another aspect of the invention, a shoe has been provided that is arranged and designed to support an ankle of a foot. The shoe comprises a sole inliner, a coupling, a back inliner, and an upper. The sole inliner is configured for a sole of the foot, while the back inliner is configured for a back of the foot. The coupling movably couples the sole inliner to the back inliner. The upper adjustably secures the sole inliner and back inliner to the foot. The upper, the sole inliner, the coupling, and the back inliner are operable to resist lateral movement of the ankle while permitting dorsiflexion and plantar flexion movement in the foot.

In yet another aspect of the invention, a support system has been provided that is arranged and designed to support an ankle of a foot. The support system comprises a sole inliner, a coupling, a back inliner, an upper, and a cover. The sole inliner is configured for a sole of the foot, while the back inliner is configured for a back of the foot. The coupling movably couples the sole inliner to the back inliner and includes a biasing member to bias the sole inliner and back inliner towards an angle. The upper adjustably secures the sole inliner and back inliner to the foot. The cover is arranged and designed to surround the upper. The upper, the sole inliner, the coupling, and the back inliner are operable to resist lateral movement of the ankle while permitting dorsiflexion and plantar flexion movement in the foot; and, the upper, the sole inliner, the coupling, the back inliner, and the cover are configured for integration within a shoe.

In yet another aspect of the invention, a support system has been provided that is arranged and designed to support an ankle of a foot. The support system comprises a sole inliner, a back inliner, and an upper. The sole inliner is configured for a sole of the foot, while the back inliner is configured for a back of the foot. The upper is coupled to both the sole inliner and the back inliner and includes a cutout, which permits dorsiflexion and plantar flexion movement in the foot. The upper, the sole inliner, and the back inliner are operable to resist lateral movement of the ankle.

The present invention provides a profusion of technical advantages that include the capability to facilitate the support of an ankle of a foot. Another technical advantage of the present invention includes the capability to resist lateral movement of the ankle while permitting dorsiflexion and plantar flexion movement in the foot.

Another technical advantage of the present invention includes the capability to reduce the time and effort needed to obtain a support for an ankle.

Yet another technical advantage of the present invention includes the capability to increase the safety of an ankle, during athletic performance.

Yet another technical advantage of the present invention includes the capability to provide a bias of a foot into desired motions.

Yet another technical advantage of the present invention includes the capability to provide an adjustable bias, which biases a foot into desired motions.

Yet another technical advantage of the present invention includes the capability of providing a reusable support.

Yet another technical advantage of the present invention includes the capability of providing a support that maintains support throughout an activity.

Yet another technical advantage of the present invention includes the capability of providing a support that can be integrated into a show or serve as the shoe, itself.

Other technical advantages are readily apparent to one skilled in the art from the following figures, description, and claims.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which.

DETAILED DESCRIPTION OF THE INVENTION

It should be understood at the outset that although an exemplary implementation of the present invention is illustrated below, the present invention may be implemented using any number of techniques, whether currently known or in existence. The present invention should in no way be limited to the exemplary implementations, drawings, and techniques illustrated below, including the exemplary design and implementation illustrated and described herein.

One aspect of the support system 100 is an ability to resist certain undesirable lateral movements in the foot or ankle—that is, an inversion/eversion movement—while facilitating desirable dorsiflexion and plantar flexion movements—that is an upward movement of the foot (dorsiflexion) and a bending of the foot toward the plantar surface or sole of the foot (plantar flexion). Several configurations of the invention, as will be described below, facilitate such a purpose. Additionally, in some aspects of the invention, dorsiflexion and/or plantar flexion movement is encouraged via the use of a biasing member.

The support system 100 can either be utilized as a component of a shoe or as a shoe, itself. Therefore, with general reference to the several aspects of the invention, described herein, it should be understood that other shoe components, now known or later developed, can be incorporated with the general designs of the support system 100. Furthermore, the discussion of the support system 100 as described herein is intended as only setting forth illustrative concepts, which can be expounded upon by one of ordinary skill in the art.

While the support system 100 can be implemented in a virtual limitless number of applications, several activities are contemplated as reaping benefits from the design. Such activities include, but are not limited to, baseball, basketball, bowling, cheerleading, cycling, dancing, fencing, football, golf, hockey, horse racing, hunting, lacrosse, paintball, power lifting, racquetball, rodeo, skateboarding, soccer, softball, tennis, track and field, volleyball, and wrestling. Other contemplated uses of the support system 100 include uses by infants in corrective shoe designs and use by individuals—e.g, with weak ankles or ankles that are recovering from a recent injury—as everyday shoes. Additionally, some individuals may use the support system 100 as strengthening or conditioning shoes as will be described more below with reference to FIGS. 4A-4C. Other uses of the support system 100 should become apparent to one of ordinary skill in the art.

Figure 1:
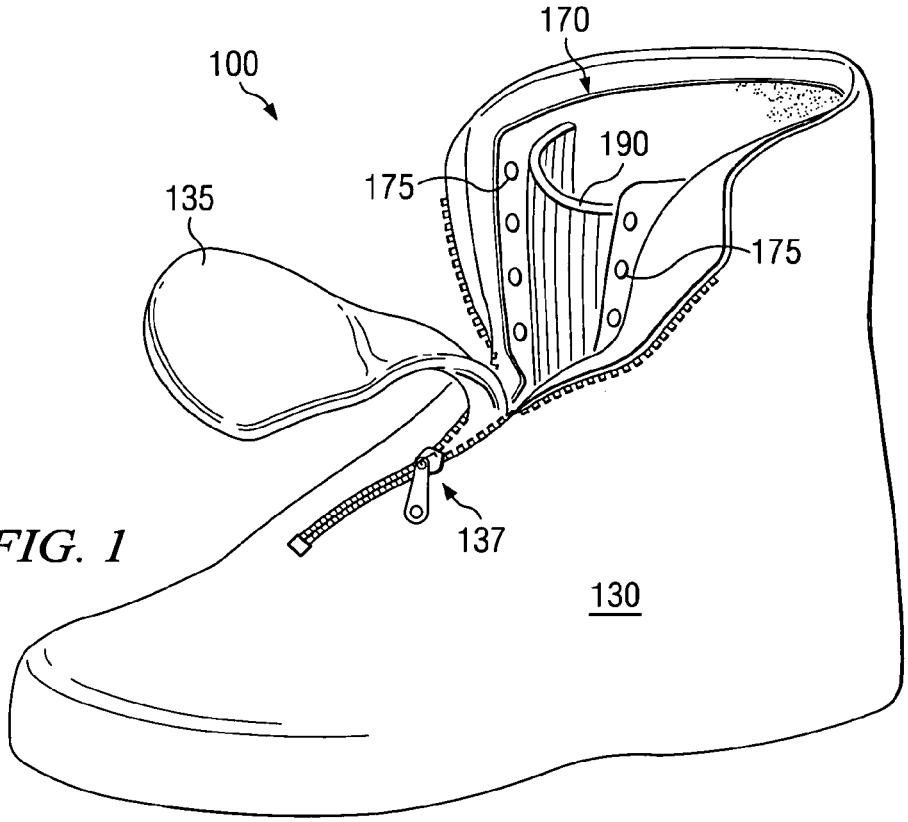
FIG. 1 is a side perspective view of an illustration of the support system, according to an aspect of the invention.

FIG. 1 shows an illustrative aspect of the support system 100. In this illustrative aspect of the invention, several components of the support system 100 are seen, namely a cover 130 and an upper 170. The cover 130 provides an outer protective coating for the inner component parts of the support system 100 (described more in FIG. 2). The cover 130, additionally, provides a clean overlay finish and can be outfitted with several designs and other shoe components—e.g., cleats or spikes. While such a cover 130 is shown in this illustrative aspect of the invention, it is to be understood that other aspects of the invention may not incorporate a cover 130, but rather utilize other component parts of the support system 100 or other component parts of a standard shoe. The cover 130, as shown in this aspect, includes a zipper 137. While such a zipper 137 is shown, one of ordinary skill in the art should recognize that other devices could additionally be used with a cover 130—e.g., lacing (shown in FIG. 7B) or straps—including devices that are now known or that are later developed.

The upper 170 is seen extending just from beyond the unzipped portion of the cover 130. The upper 170, described more with reference to FIGS. 2 and 3, can include items such as a flexible member 190 and lace holes 175.

Figure 2:
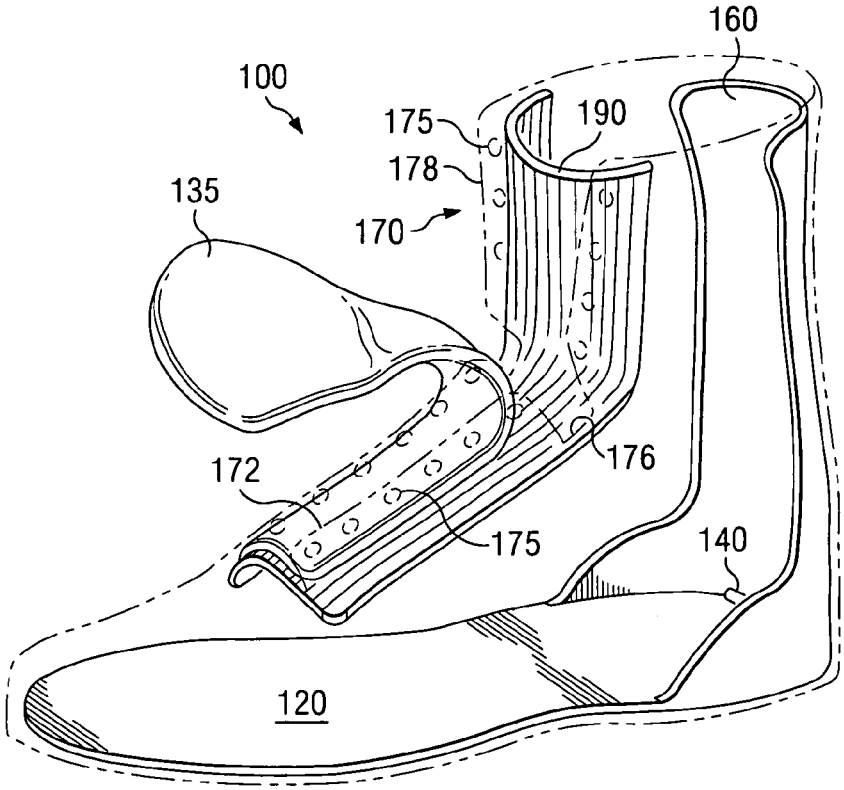
FIG. 2 is a side perspective view of the sole inliner, the back inliner, and the upper.

FIG. 2 shows a configuration of the support system 100 with the cover 130 removed. As described above, some aspects of the invention may not include a cover 130 and can, for example, include only the component parts shown in FIG. 2. In such configurations, the component part of FIG. 2 can either serve as component parts of a shoe or as the shoe, themselves—e.g., the upper 170 could serve as the outermost coating of the shoe. In FIG. 2, the upper 170 has been ghosted to show several component parts of this aspect of the support system 100, namely a sole inliner 120, a coupling 140, a back inliner 160. Generally, the upper 170, the sole inliner 120, the back inliner 160, and the coupling 140 work together to facilitate a dorsiflexion and planter flexion movement in a foot, while resisting a lateral movement of a foot. In aspects incorporating the cover 130 (FIG. 1), the cover 130 can additionally help to facilitate/resist these movements. With a description of resistance to lateral movement of a foot, it should be understood that this resistance is not necessarily an absolute resistance—that is, a resistance that allows no movement. Some lateral movement may occur in the foot—e.g., lateral movement that is part of natural movement of a foot in a particular activity. Thus, the resistance to lateral movement of a foot, as described herein, is a resistance to a lateral movement of a foot that is beyond that desired in a particular activity. For example, in some activities the undesired lateral movement may be lateral movement that causes injuries. In yet other activities, the undesirable lateral movement can be a lateral movement that detracts from a desired form that enhances performances. Ultimately, the degree to which lateral movement is minimized/resisted will depend on the dynamics of the activity in which the support system 100 is being utilized.

The sole inliner 120, generally conforms to a sole of a foot, while the back inliner 160 generally conforms to a back of a foot, namely the Achilles tendon. In one aspect of the invention, the back inliner 160 will extend at least one inch up the back of the foot (measured from the sole inliner 120) and preferably at least four inches up the back of the foot. While these preferences have been given, it should be expressly understood that the extension of the back inliner 160 up the back of foot can take on different sizes and configurations. To a certain degree, the extension of the back inliner 160 will depended on the activity of the foot and/or shoe in which the support system 100 will be utilized. While not shown, both the sole inliner 120 and the back inliner 160 can generally be conformed for the particular dynamics of the activity in which the support system 100 is being utilized. For example, the sole inliner 120 can include an arched design with arch supports. Other similar design and configurations will be come apparent to one of ordinary skill in the art.

The coupling 140 is positioned between the sole inliner 120 and back inliner 160 to allow a relative movement between the sole inliner 120 and back inliner 160. Such a relative movement can be seen in some respects as similar to a hinged door; however, the "hinged door" is modified to permit some lateral (eversion/inversion) movements (if so desired) and resist the undesired lateral (eversion/inversion) movements. The relative movement between the sole inliner 120 and back inliner 160 is to a large degree the movement that permits a dorsiflexion and plantar flexion movement in the foot. However, some dorsiflexion/plantar flexion movement is allowed by other component parts of the support system 100, namely flexibility provided in the sole inliner 120, and a back inliner 160. While this coupling 140 is shown, it should be expressly understood that other couplings can additionally be used, as should be recognized by one of ordinary skill in the art. Additionally, while a coupling is described in this aspect of the invention as a "hinged door", it should be expressly understood that in others aspects of the invention, the coupling can be a solid piece coupling that couples the sole inliner 120 to the back inliner 160 such that the sole inliner 120 and the back inliner 160 are seen as an integral piece. More details of such an aspect of the invention are described below with reference to FIG. 7A.

The upper 170 couples to both the back inliner 160 and sole inliner 120, allowing adjustable positioning of a foot to the sole inliner 120 and back inliner 160. The upper 170 in this aspect includes a flexible member 190, which couples to an opening of the upper 170 and partially circumscribes a foot positioned in the upper 170. The flexible member 190 serves as an initial engaging mechanism of the upper 170 to the foot; however, in other aspects the flexible member 190 can serve as the sole connection member of the upper 170 to a foot. Other variations will become apparent to one of ordinary skill in the art.

The upper 170 in this aspect includes a cutout 176 that divides the upper 170 into a top upper member 178 and a bottom upper member 172. The top upper member 178 and bottom upper member 172 both include lace holes 175, which allow laces to be threaded therethrough. Such a configuration allows independent adjustable engagement of the top upper member 178 and bottom upper member 172 to a foot, and facilitates the dorsiflexion/plantar flexion movement of a foot. Other configurations, which allow an engagement of the upper 170 onto a foot (as parts or as whole) should become apparent to one of ordinary skill in the art. For example, in other aspects, the upper 170 can include Velcro strips or adjustable straps that aid in adjustably securing the upper 170 to a foot. In this aspect, a flap 135 lies over the flexible member 190 to facilitate the lacing through the lace holes 175 of the top upper member 178 and bottom upper member 172.

As described above, the upper 170, the coupling 140, the sole inliner 120, and the back inliner 160 are generally designed to resist a lateral movement in the foot or ankle, while facilitating desired dorsiflexion and plantar flexion movements. Therefore, the construction/choice of materials for these component parts (the upper 170, the coupling 140, the sole inliner 120, and the back inliner 160) must be chosen accordingly. As an example, intended for illustrative purposes only, an attempted undesired lateral movement of a foot could be transferred to the upper 170 and through the sole inliner 120 to the coupling 140. With such a transfer of forces, each of the component parts must withstand the force, being imparted thereon. In such an example, suitable materials for the upper 170 include a variety of leathers or synthetic materials, including high strength woven fabrics. Suitable materials for the sole inliner 120 include, but are not limited to, a variety of thermoplastics and thermoformed materials, providing the desired rigidity in the sole inliner 120 and resistance to undesired torsion forces. Similarly, suitable materials for the coupling 140 can include, but are not limited to, a variety of thermoplastics and thermoformed materials as well as metallic coupling pieces. At the same time these component parts (the upper 170, coupling 140, sole inliner 120, and back inliner 160) are working to resist the above undesired lateral movement, they are additionally working to permit the desired dorsiflexion/plantar flexion movements in the foot. Therefore, as briefly referenced above, the sole inliner 120 (made e.g., of a thermoplastic, thermoformed material, or the like) can have some flexibility—e.g, a flexibility across the arch. Several variations of design configurations and material choices to accomplish these purposes will become apparent to one of ordinary skill in the art.

Figure 3:
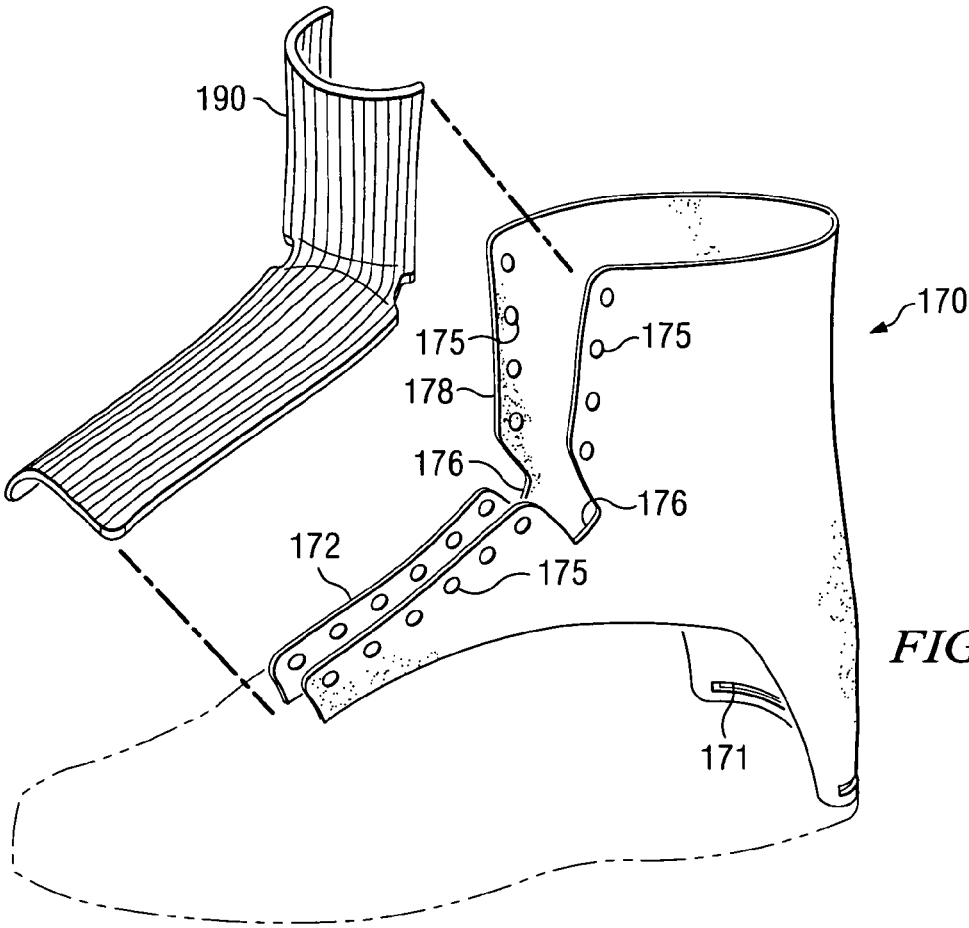
FIG. 3 is a side perspective view of the upper, in isolation.

FIG. 3 shows an isolated view of the upper 170 with the flap 135 and flexible member 190 removed. As described above, the flexible member 190 can extend the distance of an opening in the upper 170—serving as an initial engagement of the upper 170 with the foot. The cutout 176 allows the top upper member 178 and the bottom upper member 172 to independently engage a foot—e.g., via lacing. With this independent engagement, the cutout 176 facilitates the dorsiflexion/plantar flexion movements in the foot—separating the top upper member 178 from the bottom upper member 172. While the cutout 176 in this aspect of the invention has been shown as a small cutout, it should be expressly understood that in other aspects of the invention, the cutout can be much larger with different configurations. The coupling of the sole inliner 120 (not seen in this figure) and back inliner 160 (not seen in this figure) to the upper 170 can take on an numerous techniques, now known or later developed—e.g., through insertion of the sole inliner 120 and back inliner 160 through insertion groove 171.

Figure 4A:
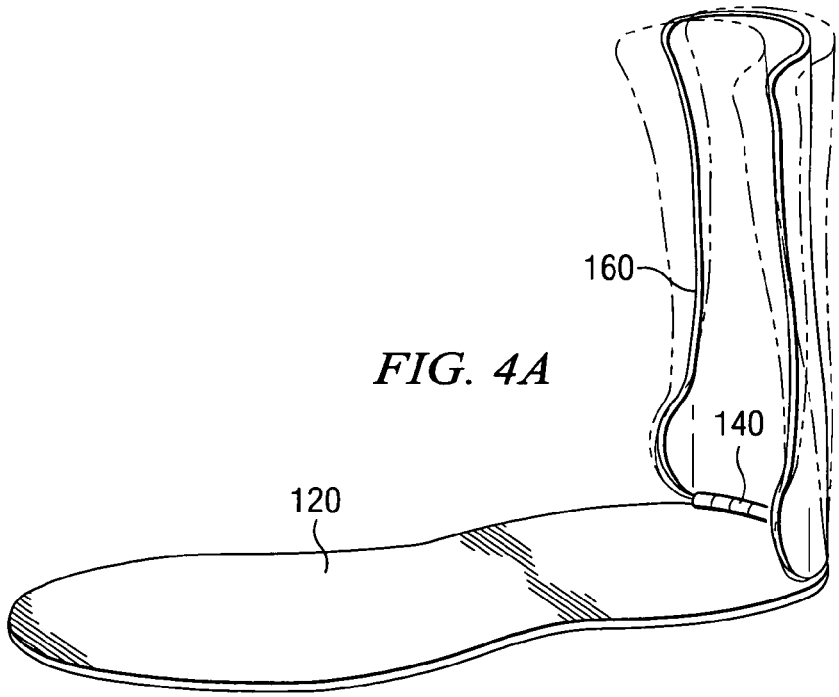
FIGS. 4A is a side view of a configuration of the sole inliner and back inliner with a coupling therebetween.

FIG. 4A shows a configuration of the sole inliner 120 and back inliner 160 with the coupling 140, mounted therebetween. The back inliner 160 has been shown ghosted in several different positions to illustrate the moveable relationship between the sole inliner 120 and back inliner 160.

Figure 4B:
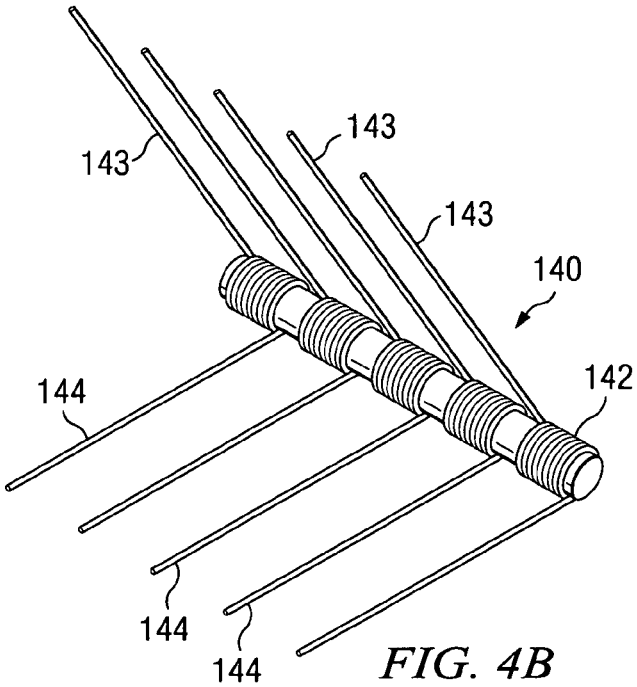
FIGS. 4B, 4C, and 4D are views of torsion springs, which can be utilized in one aspect of the support system.

FIG. 4B shows a plurality of torsion springs 142 that can be used in the coupling 140. Each of the torsion springs 142 has a back inliner extension 143, which couples with the back inliner 160, and a sole inliner extension 144, which couples with the sole inliner 120. Such torsion springs 142, as should become apparent to one of ordinary skill in the art, can be used as a biasing member to provide a bias in a predefined direction—e.g., in the illustration of FIG. 4B, biasing an angle between the back inliner 160 and sole inliner 120 towards a predefined angle.

Figure 4C:
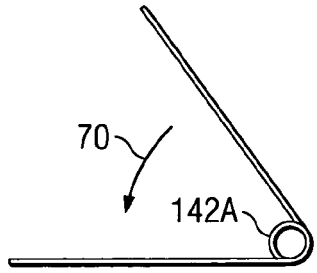
Figure 4D:
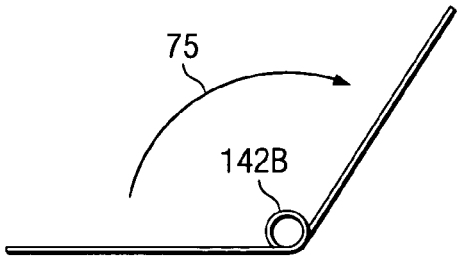

FIGS. 4C AND 4D show two types of torsions springs 142, which can be incorporated into the coupling 140 of FIG. 4A. FIG. 4C shoes an acute angle torsion spring 142A, which generally biases towards an angle in the direction of the arrow 70. FIG. 4D shoes an obtuse angle torsion spring 142B, which generally biases towards an angle in the direction of the arrow 75. Biasing towards an acute angle with the acute angle torsion spring 142A would force a foot positioned within the support system 100 into dorsiflexion—alternatively viewed as an individual being encouraged/forced onto the balls of his feet. Benefits of such an encouraged action should become apparent to one of ordinary skill in the art—e.g., applications in football, wrestling, and the like. Additionally, the use of higher strength biasing member, which forces dorsiflexion, can be used as a conditioning mechanism for lower leg muscles. As an example, the normal motion of a foot in walking, running, or jumping motion is for the foot to extend beyond an acute angle. Therefore, for the foot to extend to these positions, the lower muscles of the legs (for example, calf muscles) must overcome the bias towards an acute angle. The use of the support system 100 having such a biasing member (e.g., the acute angle torsion spring 142A) could therefore exercise the calf muscles as an individual jumps, runs, sprints, or walks.

The biasing towards an obtuse angle with the obtuse angle torsion spring 142B would force a foot positioned within the support system 100 into plantar flexion—alternatively viewed as an individual being encouraged/forced to extend his or her foot. The benefits of such an encouraged action should, additionally, be recognized by one of ordinary skill in the art. For example, field goal kickers could be encouraged to point their foot when kicking a football; ballets dancers could be encouraged to point their feet in one of the many plurality of pointed toe movements associated with ballet; and high jumpers and long jumpers could be encouraged to jump—a natural pointed foot activity. A higher-powered acute angle torsion spring 142B, in a manner similar to that described above, can exercise the lower muscles of the legs; and, in some aspects may even enhance performance—e.g., vertical jumping ability.

Figure 5A:
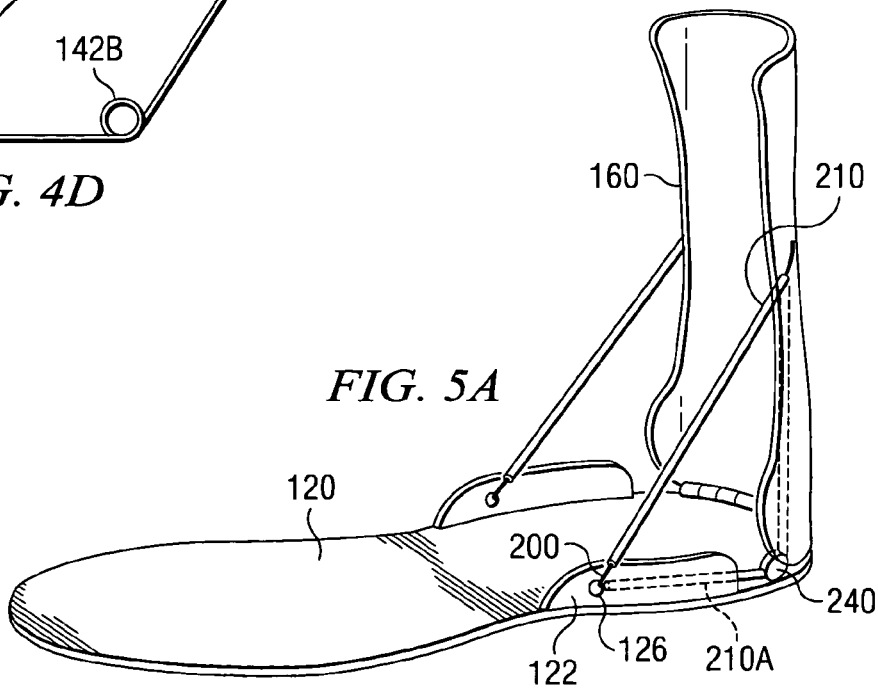
FIG. 5A is a side perspective view of a configuration of the sole inliner, back inliner, and coupling with a cord member being used as a biasing member.

FIG. 5A shows another configuration of the sole inliner 120 and back inliner 160 with the coupling 140, mounted therebetween and including a biasing member. The biasing member in this configuration is a compression cord 200, extended between the sole inliner 120 and back inliner 160. The compression cord 200 preferably is made of a material that prefers a compressed state, but is additionally capable of expansion—the expansion causing a higher compressive force in the material. Such properties of a material should become apparent to one of ordinary skill in the art—e.g., something having characteristics similar to that of a rubber band.

The compression cord 200 is threaded through support holes 126 in side supports 122 of the sole inliner 120. The compression cord 200 can then be positioned through a cord housing 210 strung between the sole inliner 120 and back inliner 160.

Figure 5B:
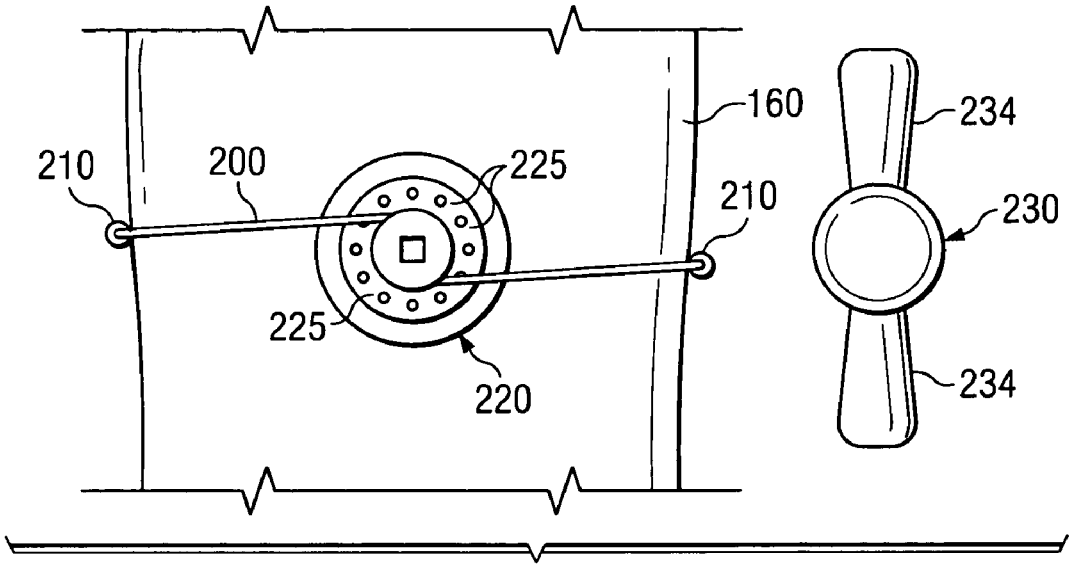
FIG. 5B is a view of a cord winder and corresponding winder key, which can be used with a cord member.

With reference to FIG. 5B, a backside of the back inliner 160 is shown. The compression cords 200 on each side of the back inliner 160 are shown, extending from the cord housing 210. Each of the compression cords 200 extends and wraps around a cord winder 220. While not shown in detail, the cord winder 220 can be a rotatably mounted assembly, which is spring loaded with springs 225—the springs 225 forcing an object into engagement with the cord winder and preventing rotation of the cord winder 220. When the springs 225 are compressed, the cord winder 220 is allowed to rotate. The winder key 230 serves the function of compressing the springs 225 and allowing the cord winder 220 to rotate. The winder key 230 additionally engages the cord winder 220, whereby the winder key arms 234 can be rotated to provide a torque in rotating the cord winder 220. The construction of such a mechanical design (cord winder 220, springs 225, winder key 230) should be within the skill of one of ordinary skill in the art; and, other similar designs serving a similar purpose should become apparent. With rotation of the cord winder 220—e.g., in the clockwise direction with reference to FIG. 5B—the compression cords 200 are wound in and expanded—thus, causing more of a compressive force. Likewise, a counter clockwise rotation causes the compression cords 200 to be released, reducing the compressive force. As such, the compressive force is thereby adjustable.

With reference to FIG. 5A, once again, the configuration shows a biasing of an angle between the sole inliner 120 and back inliner 160 towards an acute angle via use of the compression in the compression cord 200. Alternatively, the compression cord 200 can be wrapped around a redirection member 240 (shown in phantom view), allowing the biasing of an angle between the sole inliner 120 and back inliner 160 towards an acute angle—the shortest compressive distance. With these positions, it is additionally contemplated that a track can be incorporated between the position, generally indicated by the support hole 126 and the position generally indicated by the redirection member 240 to allow a change between the acute/obtuse angle biasing. Other similar configurations and variations should become apparent to one of ordinary skill in the art.

Figure 6A:
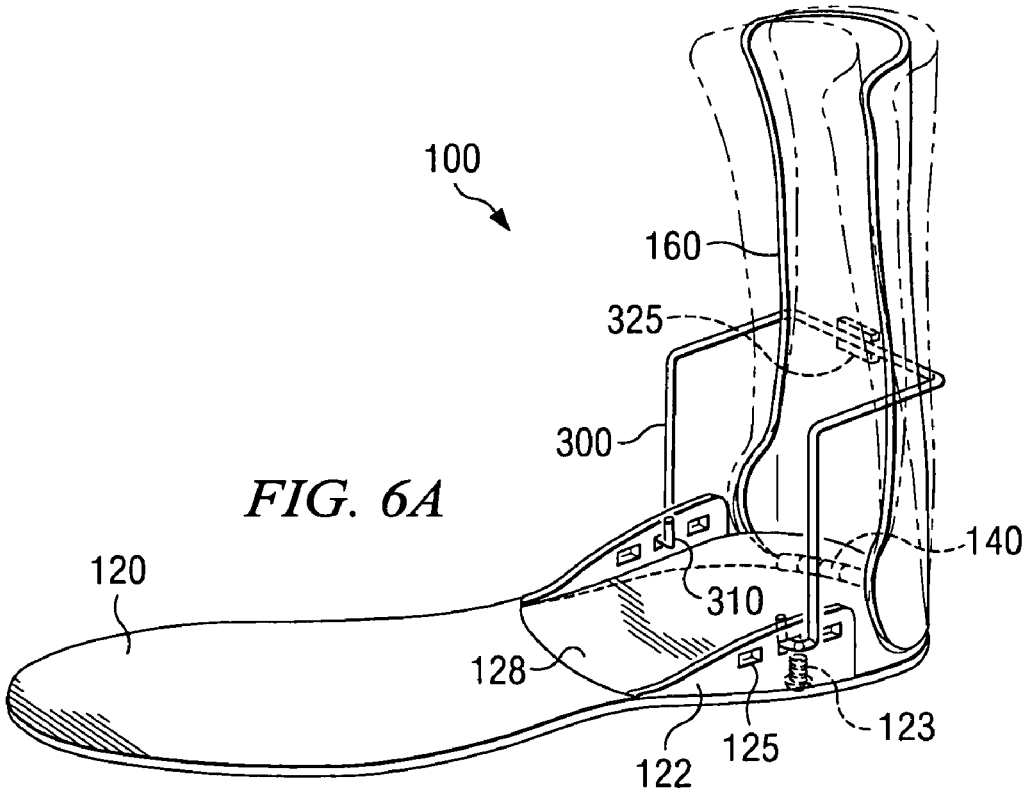
FIG. 6A is a side perspective view of a configuration of the sole inliner, back inliner, and coupling with a compression member being used as a biasing member.

FIG. 6A shows another configuration of the sole inliner 120 and back inliner 160 with the coupling 140, mounted therebetween and including a biasing member and a wedge 128. The biasing member in this configuration is a compression member 300. The compression member 300 is a removable assembly that can be positioned between the sole inliner 120 and the back inliner 160. In the configuration shown in FIG. 6A, locking pieces 310 on the end of the compression member 300 are initially positioned through a groove 125 in a side support 122 of the sole inliner 120. After such positioning, the compression member 300 is rotated, preventing the locking pieces 310 from pulling back through the grooves 125. Alternatively, the compression member 300 can be locked down to the sole inliner 120 with a screw 123, described in more detail with reference to FIG. 7A. The compression member 300 can be coupled to the back inliner 160, e.g., using a longitudinal snap member 325 on the back inliner 160 or the knobs 330, described below.

The wedge 128 in this aspect is shown positioned on top of the sole inliner 120. The wedge 128, as will be recognized by one of ordinary skill in the art, elevates the heel of the foot above the sole inliner 120—thereby placing an athlete on the ball of his foot. The wedge 128 can be outfitted with cushions/and or springs to protect the heel of the foot in certain activities. The illustration of the wedge 128 in this aspect is intended as showing one of the many features, which can be incorporated within the support system 100 and should not be construed as being required in every aspect of the invention.

Figure 6B:
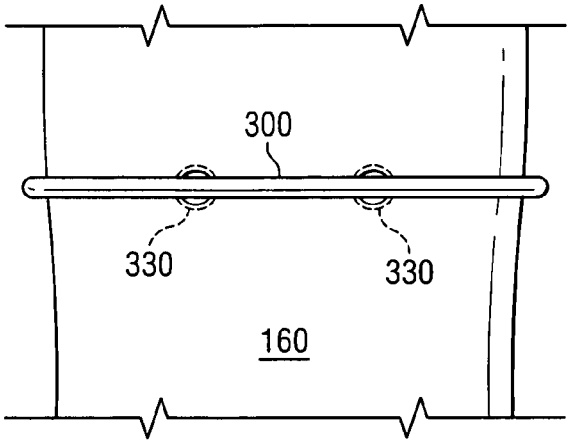
FIGS. 6B & 6C are perspective views of a configuration, which can be used to couple a compression member to a back of a back inliner.
Figure 6C:
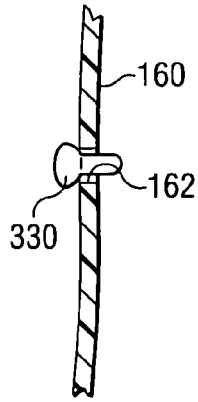

With reference to FIGS. 6B AND 6C, an alternative coupling of the compression member 300 to the back of the back inliner 160 can be seen. One or more knobs 330 on the compression member 300 are inserted through a hole 162 in the back inliner 160. Other coupling techniques should become apparent to one of ordinary skill in the art.

With reference, once again, to FIG. 6A, several grooves 125 are provided—thus, allowing an adjustment of the compression force, for example, with placement in different grooves 125. Additionally, compression members 300 of different compressive qualities can be utilized to further enhancing an adjustment of compression. Furthermore, a redirection member 240 (seen in FIG. 5A), can be incorporated to change the direction of biasing between the obtuse/acute angle. While the compression member 300 is shown bent between the sole inliner 120 and back inliner 160, it is contemplated that the compression member 300 can additionally be linearly positioned between the sole inliner 120 and back inliner 160—that is, positioned in a straight line.

While such biasing members have been shown with reference to FIGS. 4B, 4C, 4D, 5A, 5B, 6A, 6B, and 6C, it is to be expressly understood that such biasing members are only illustrative of some configurations of biasing, which can be utilized. Other biasing mechanisms will become apparent to one of ordinary skill in the art. Additionally, component parts of a biasing member disclosed in one configuration, described herein, can be used in another configuration, described herein.

Figure 7A:
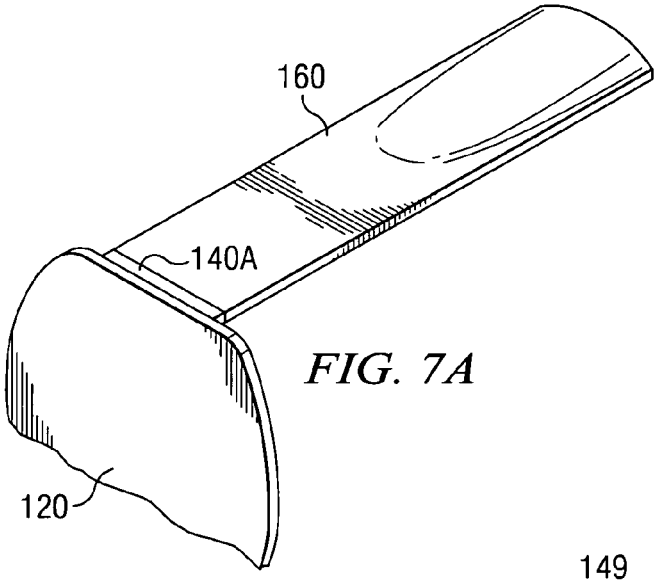
FIGS. 7A, 7B, AND 7C show several configurations of couplings between the sole inliner and the back inliner, according to aspects of the invention.
Figure 7B:
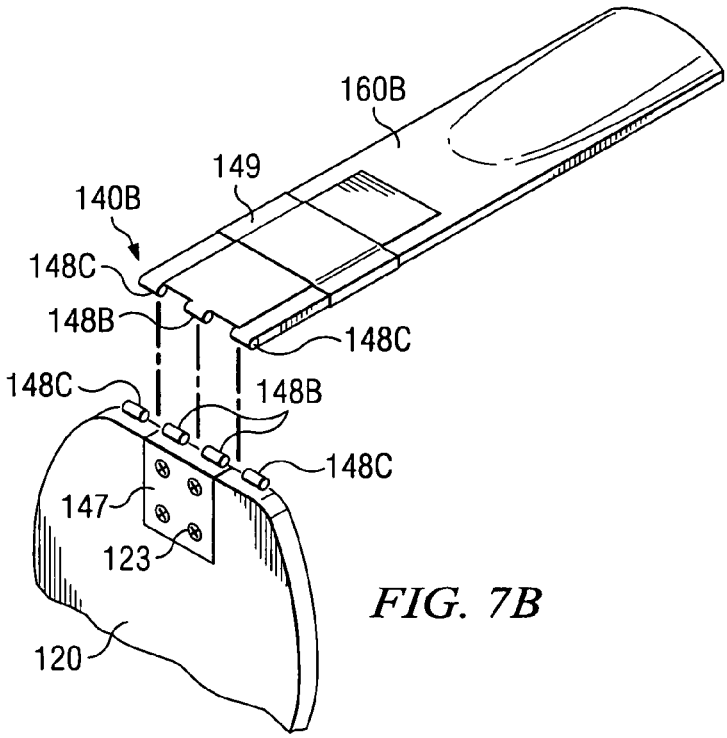
Figure 7C:
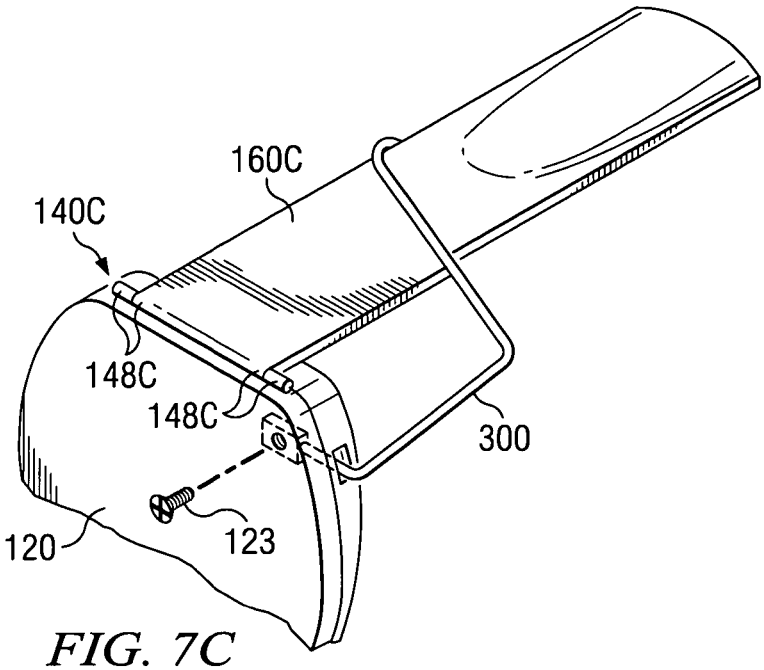

FIGS. 7A, 7B, AND 7C show several configurations of the coupling 140 between the sole inliner 120 and the back inliner 160, from a view of the underside of the sole inliner 120. FIG. 7A shows a coupling 140A that makes the sole inliner 120 and back inliner 160 appear as an integrated piece. The coupling 140A can be made of the same material as the sole inliner 120 and back inliner 160; or, the coupling 140A can be made of a different material—e.g., a more flexible material.

FIG. 7B shows another coupling 140B that can be utilized, according to an aspect of the invention. The coupling 140B includes a coupling piece 147 and hinge members 148B, 148C. Hinge members 148C are on the ends of the sole inliner 120 and back inliner 160, while hinge members 148B are on the coupling piece 147. Coupling piece 147 includes a portion that can be mounted to the sole inliner 120 using screws 123 and a portion that can be mounted to the back inliner 160 using a strap 149.

FIG. 7C shows another coupling 140C that can be utilized, according to an aspect of the invention. Coupling 140C is a hinged coupling, having hinge members 148C. The hinge members 148C are on the ends of the sole inliner 120 and back inliner 160B, allowing a movable coupling between the sole inliner and back inliner 160B.

Additionally shown in FIG. 7C is a compression member 300, which can be coupled to the sole inliner 120 with a screw 123. The compression member 130C in this aspect is strewn around the back of the back inliner 160C and hooked, thereto.

With reference to FIGS. 7B and 7C, it can bee seen that the sole inliners 120 are the same while the back inliners 160B, 160C have slight variations. Such an illustration is intended as showing an interchangeability of several aspects of the invention.

While the couplings 140A, 140B, and 140C have been described herein, it should be expressly understood that other configurations of the support system 100 can utilize other couplings 140.

Figure 8A:
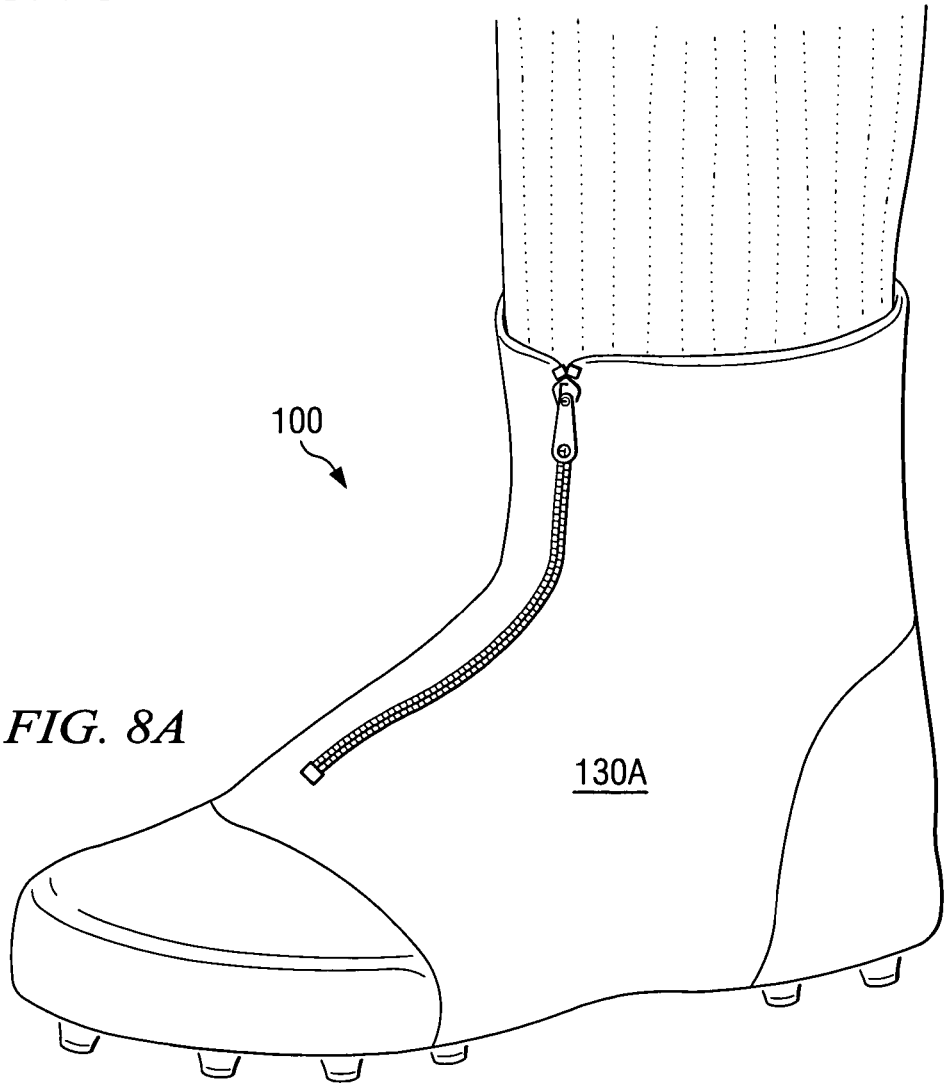
FIGS. 8A, 8B, and 8C show illustrative uses of the support system.
Figure 8B:
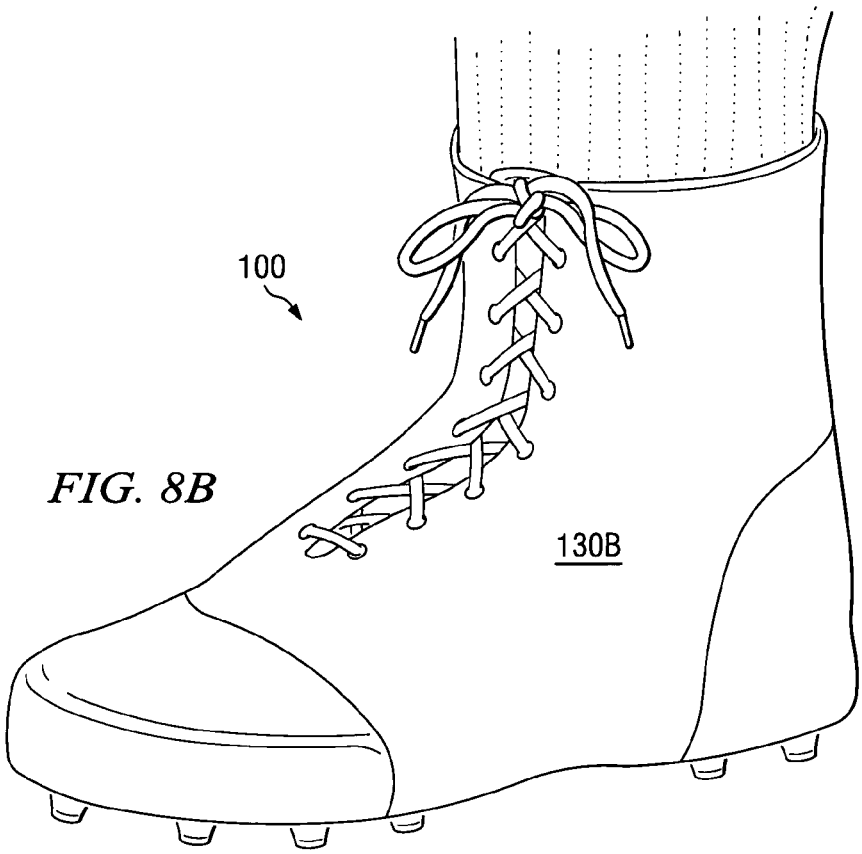
Figure 8C:
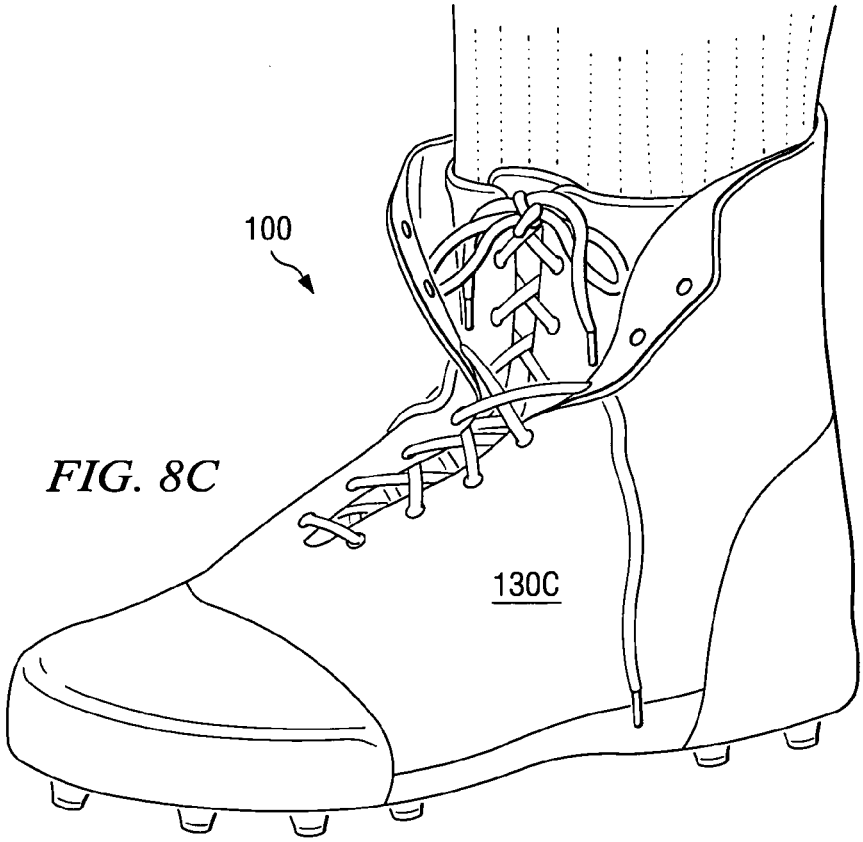

FIGS. 8A, 8B, AND 8C show several configurations of the support system 100 in an exemplary use, namely football. While such an exemplary use is shown, it should be expressly understood that other uses are contemplated. In FIGS. 8A, 8B, and 8C, the support system 100 serves as a shoe, using a cover 130 outfitted with football cleats. The support system 100 can utilize any of the configurations described herein. FIG. 8A shows a cover 130A, being configured with a zipper design; FIG. 8B shows a cover 130B with a single lace design; and FIG. 8C shows a cover 130C with a double lace design.

Thus, it is apparent that there has been provided, in accordance with the present invention, a support system that satisfies one or more of the advantages set forth above. Although the preferred aspect has been described, it should be understood that various changes, substitutions, and alterations can be made herein without departing from the scope of the present invention, even if all, one, or some of the advantages identified above are not present. For example, the upper 170 can be used as an outermost portion of a shoe. Additionally, any of a variety of shoe technologies and material, now known or later developed, may be incorporated to facilitate the support system 100. These are only a few of the examples of other arrangements or configurations of the system that is contemplated and covered by the present invention.

The various components, configurations, and materials described and illustrated in the preferred aspects as discrete or separate may be combined or integrated with other components, configurations, and materials of other aspects or other shoe designs without departing from the scope of the present invention. Other examples of changes, substitutions, and alterations are readily ascertainable by one skilled in the art and could be made without departing from the spirit and scope of the present invention.

What is claimed is:

1. A shoe arranged and designed to support an ankle of a foot, the shoe comprising:

a sole inliner configured for a sole of the foot, the sole inliner being flexible generally across the arch of the foot;

a back inliner coupled to the sole inliner, wherein the back inliner is configured for a back of the foot without projecting forward of the ankle, and wherein the back inliner and sole inliner do not extend over the ankle of the foot; and an upper coupled to both the sole inliner and the back inliner, wherein the upper adjustably secures the sole inliner and back inliner to the foot, and wherein the upper, the sole inliner, and the back inliner are operable to resist lateral movement of the ankle; and wherein the shoe is configured for direct contact and non-binding engagement with the ground or other support surface.

2. The shoe of claim 1, wherein the upper further comprises a top upper member and a bottom upper member.

3. The shoe of claim 1, wherein the upper further comprises:

a flexible member, which facilitates an initial engagement of the upper to the foot.

4. The shoe of claim 1, wherein the upper further comprises a top upper member and a bottom upper member, and the top upper member and bottom upper member independently provide engagement of the upper to the foot.

5. The shoe of claim 1, further comprising a cover which surrounds the upper, the sole inliner and the back inliner.

6. The shoe of claim 5, wherein the upper further comprises a flexible member and a top upper member and a bottom upper member, the flexible member provides an initial engagement of the upper to the foot, and the top upper member and bottom upper member independently provide further engagement of the upper to the foot.

7. The shoe of claim 1, further comprising:

a biasing member for providing a biasing force between the sole inliner and back inliner.

8. The shoe of claim 1, wherein a coupling is provided between the sole inliner and the back inliner that includes a biasing member.

9. The shoe of claim 8, wherein the biasing member causes a bias towards one of an obtuse angle or acute angle between the sole inliner and the back inliner.

10. The shoe of claim 8, wherein the biasing member includes at least one torsion spring.

11. The shoe of claim 1, wherein the shoe is provided with cleats or spikes.

12. The shoe of claim 1, wherein the shoe has a generally flat non-cleated or non-spiked sole.

13. The shoe of claim 1, wherein the sole inliner and back inliner are integrated as one piece.

14. The shoe of claim 1, wherein the back inliner extends at least one inch up the back of the foot.

15. The shoe of claim 1, wherein the back inliner extends at least four inches up the back of the foot.

16. The shoe of claim 1, wherein the back inliner is movable relative to the sole inliner to permit at least one of dorsiflexion and plantar flexion movement in the foot.

17. The shoe of claim 16, wherein the relative movability of the back inliner and sole inliner is facilitated by the flexibility of materials of at least one of the back inliner and sole inliner.

18. The shoe of claim 16, wherein:

the relative movability of the back inliner and sole inliner is facilitated by a hinge.

19. The shoe of claim 1, wherein:

the back inliner and the sole inliner do not extend over the sides of the foot.

20. A shoe arranged and designed to support an ankle of a foot, the shoe comprising:

a sole inliner configured for a sole of the foot, the sole inliner being flexible generally across the arch of the foot;

a back inliner non-movably coupled to the sole inliner, wherein the back inliner is configured for a back of the foot without projecting forward of the ankle, and wherein the back inliner and sole inliner do not extend over the ankle and sides of the foot; and an upper coupled to both the sole inliner and the back inliner, wherein the upper adjustably secures the sole inliner and back inliner to the foot, and wherein the upper, the sole inliner and the back inliner are operable to resist lateral movement of the ankle; and wherein the shoe is configured for direct contact and non-binding engagement with the ground or other support surface.

21. The shoe of claim 20, wherein the upper further comprises a top upper member and a bottom upper member.

22. The shoe of claim 20, wherein the upper further comprises:

a flexible member, which facilitates an initial engagement of the upper to the foot.

23. The shoe of claim 20, wherein the upper further comprises a top upper member and a bottom upper member, and the top upper member and bottom upper member independently provide engagement of the upper to the foot.

24. The shoe of claim 23, wherein the top upper member and bottom upper member are adapted to receive laces.

25. The shoe of claim 20, further comprising a cover which surrounds the upper, the sole inliner and the back inliner.

26. The shoe of claim 25, wherein the upper further comprises a flexible member and a top upper member and a bottom upper member, the flexible member provides an initial engagement of the tipper to the foot, and the top upper member and bottom tipper member independently provide further engagement of the upper to the foot.

27. The shoe of claim 20, wherein the shoe is provided with cleats or spikes.

28. The shoe of claim 20, wherein the shoe has a generally flat non-cleated or non-spiked sole.

29. The shoe of claim 20, wherein the sole inliner and back inliner are integrated as one piece.

30. The shoe of claim 20, wherein the back inliner extends at least one inch up the back of the foot.

31. The shoe of claim 20, wherein the back inliner extends at least four inches up the back of the foot.

32. The shoe of claim 20, wherein:

the back inliner and the sole inliner do not extend over the sides of the foot.

33. A shoe arranged and designed to support an ankle of a foot, the shoe comprising:

a sole inliner configured for a sole of the foot, the sole inliner being flexible generally across the arch of the foot;

a back inliner coupled to the sole inliner, the back inliner being movable relative to the sole inliner to permit at least one of dorsiflexion and plantar flex ion movement in the foot without projecting forward of the ankle, wherein the relative movability of the back inliner and sole inliner are facilitated by the flexibility of materials of at least one the back inliner and sole inliner; wherein the back inliner is configured for a back of the foot, and wherein the back inliner and sole inliner do not extend over the ankle and sides of the foot and without cupping of the heel to hold the heel in a fixed position; and an upper coupled to both the sole inliner and the back inliner, wherein the upper adjustably secures the sole inliner and back inliner to the foot, and wherein the upper, the sole inliner and the back inliner are operable to resist lateral movement of the ankle; and wherein the shoe is configured for direct contact and non-binding engagement with the ground or other support surface.

34. The shoe of claim 33, wherein the upper further comprises a top upper member and a bottom upper member.

35. The shoe of claim 33, wherein the upper further comprises:

a flexible member, which facilitates an initial engagement of the upper to the foot.

36. The shoe of claim 33, wherein the upper further comprises a top upper member and a bottom upper member, and the top upper member and bottom upper member independently provide engagement of the upper to the foot.

37. The shoe of claim 36, wherein the top upper member and bottom upper member are adapted to receive laces.

38. The shoe of claim 33, further comprising a cover which surrounds the upper, the sole inliner and the back inliner.

39. The shoe of claim 37, wherein the upper further comprises a flexible member and a top upper member and a bottom upper member, the flexible member provides an initial engagement of the upper to the foot, and the top upper member and bottom upper member independently provide further engagement of the upper to the foot.

40. The shoe of claim 33, further comprising:

a biasing member for providing a biasing force between the sole inliner and back inliner.

41. The shoe of claim 33, wherein a coupling is provided between the sole inliner and the back inliner that includes a biasing member.

42. The shoe of claim 41, wherein the biasing member causes a bias towards one of an obtuse or an acute angle between the sole inliner and the back inliner.

43. The shoe of claim 41, wherein the biasing member includes at least one torsion spring.

44. The shoe of claim 33, wherein the shoe is provided with cleats or spikes.

45. The shoe of claim 33, wherein the shoe has a generally flat non-cleated or non-spiked sole.

46. The shoe of claim 33, wherein the sole inliner and back inliner are integrated as one piece.

47. The shoe of claim 33, wherein the back inliner extends at least one inch up the back of the foot.

48. The shoe of claim 33, wherein the back inliner extends at least four inches up the back of the foot.

49. The shoe of claim 33, wherein the relative movability of the back inliner and sole inliner occurs at a position below the ankle of the foot.

50. The shoe of claim 33, wherein:

the back inliner and the sole inliner do not extend over the sides of the foot.

51. The shoe of claim 33, wherein:

the relative movability of the back inliner and sole inliner is facilitated by a hinge.

52. A shoe arranged and designed to support an ankle of a foot, the shoe comprising:

a sole inliner configured for a sole of the foot, the sole inliner being flexible generally across the arch of the foot;

a coupling;

a back inliner movably coupled to the sole inliner with the coupling, the movable coupling being located at a position below the ankle of the foot, wherein the back inliner is configured for a back of the foot without projecting forward of the ankle, and wherein the back inliner, coupling and sole inliner do not extend over the ankle and sides of the foot; and an upper coupled to both the sole inliner and the back inliner, wherein the upper adjustably secures the sole inliner and back inliner to the foot, and wherein the upper, the sole inliner, the coupling, and the back inliner are operable to resist lateral movement of the ankle; and wherein the shoe is configured for direct contact and non-binding engagement with the ground or other support surface.

53. The shoe of claim 52, wherein the coupling is positioned adjacent to a heel of the foot.

54. The shoe of claim 52, wherein the upper further comprises a top upper member and a bottom upper member.

55. The shoe of claim 52, wherein the upper further comprises:

a flexible member, which facilitates an initial engagement of the upper to the foot.

56. The shoe of claim 52, wherein the upper further comprises a top upper member and a bottom upper member, and the top upper member and bottom upper member independently provide engagement of the upper to the foot.

57. The shoe of claim 56, wherein the top upper member and bottom upper member are adapted to receive laces.

58. The shoe of claim 52, further comprising a cover which surrounds the upper, the sole inliner, the coupling, and the back inliner.

59. The shoe of claim 58, wherein:

the upper further comprises a flexible member and a top upper member and a bottom upper member, the flexible member provides an initial engagement of the upper to the foot, and the top upper member and bottom upper member independently provide further engagement of the upper to the foot.

60. The shoe of claim 59, wherein the top upper member and bottom upper member are adapted to receive laces, the flexible member includes a neoprene material, and the coupling between the sole inliner and the back inliner includes a biasing member.

61. The shoe of claim 52, wherein the coupling between the sole inliner and the back inliner includes a biasing member.

62. The shoe of claim 52, wherein the biasing member causes a bias towards one of an obtuse angle or an acute angle between the sole inliner and the back inliner.

63. The shoe of claim 61, wherein the biasing member includes at least one torsion spring.

64. The shoe of claim 52, wherein the shoe is provided with cleats or spikes.

65. The shoe of claim 52, wherein the shoe has a generally flat non-cleated or non-spiked sole.

66. The shoe of claim 52, wherein the sole inliner, back inliner and coupling are integrated as one piece.

67. The shoe of claim 52, wherein the back inliner extends at least one inch up the back of the foot.

68. The shoe of claim 52, wherein the relative movability of the back inliner and sole inliner is facilitated by the flexibility of materials of at least one of the coupling, back inliner and sole inliner.

69. The shoe of claim 52, wherein:

the back inliner and the sole inliner do not extend over the sides of the foot.

70. The shoe of claim 52, wherein:

the relative movability of the back inliner and sole inliner is facilitated by a hinge.

* * * * *